US006843369B2

(12) United States Patent
Daniels et al.

(10) Patent No.: US 6,843,369 B2
(45) Date of Patent: Jan. 18, 2005

(54) POP-UP TOILET PAPER DISPENSER

(76) Inventors: Bobbye Ford Daniels, 2442 Buttonbush Ct., Tallahassee, FL (US) 32308; Brian James Boothe, P.O. Box 5120, Raleigh, NC (US) 27650-5120

( * ) Notice: Subject to any disclaimer, the term of this patent is extended or adjusted under 35 U.S.C. 154(b) by 0 days.

(21) Appl. No.: 10/635,099

(22) Filed: Aug. 6, 2003

(65) Prior Publication Data

US 2004/0188297 A1 Sep. 30, 2004

Related U.S. Application Data

(60) Provisional application No. 60/457,624, filed on Mar. 26, 2003.

(51) Int. Cl.[7] ..... B65D 85/672

(52) U.S. Cl. ..... 206/225; 206/394; 221/269; 221/270

(58) Field of Search ..... 206/225, 233, 206/391, 394, 812; 221/268, 269, 270, 271, 274, 302; 242/559.4, 560, 560.1

(56) References Cited

U.S. PATENT DOCUMENTS 1,917,641 A 7/1933 Fairchild
3,275,133 A * 9/1966 Wood ..... 206/394
4,177,958 A 12/1979 Poole
4,273,392 A * 6/1981 Stinson ..... 312/42
4,432,451 A 2/1984 Hooser
4,607,809 A 8/1986 Sineni et al.
4,765,475 A 8/1988 Kaysserian
5,104,001 A * 4/1992 Negron ..... 221/276
5,178,298 A * 1/1993 Allina ..... 221/24
5,887,818 A 3/1999 Kelley
D430,984 S 9/2000 Camarena
6,161,794 A 12/2000 Cravatt
6,193,059 B1 2/2001 Massaro
6,302,350 B1 10/2001 Burrell et al.
6,422,503 B1 7/2002 Hoo-Kong
6,484,965 B1 11/2002 Reaves

* cited by examiner

*Primary Examiner*—Jacob K. Ackun, Jr.
(74) *Attorney, Agent, or Firm*—John Wiley Horton

(57) ABSTRACT

A toilet paper dispenser which stores several rolls in a vertical column. The rolls are individually dispensed via a swinging carriage located near the column's top. A spring-loaded follower urges the stack of rolls upward, so that as each roll is dispensed, the one immediately below takes its place. The dispensing mechanism is designed so that one and only one roll is dispensed for each cycle of the swinging carriage.

12 Claims, 10 Drawing Sheets

POP-UP TOILET PAPER DISPENSER

CROSS-REFERENCES TO RELATED APPLICATIONS

This is a non-provisional application claiming the benefit of an application previously filed under 37 C.F.R. §1.53 (c). The previous application had identity of inventorship, was filed on Mar. 26, 2003, and was assigned application Ser. No. 60/457,624.

STATEMENT REGARDING FEDERALLY SPONSORED RESEARCH OR DEVELOPMENT

Not Applicable.

MICROFICHE APPENDIX

Not Applicable

BACKGROUND OF THE INVENTION

1. Field of the Invention

This invention relates to the field of storage. More specifically, the invention comprises a vertical toilet paper roll dispenser which feeds a single roll off the top of a vertical stack of rolls.

2. Description of the Related Art

Toilet paper is customarily dispensed from a single roll, with additional rolls being stored in separate locations. This fact causes problems when the roll in use is exhausted. Some prior art devices have addressed this concern by storing multiple rolls near the point of use. However, these devices have generally been impractical and inconvenient to use.

BRIEF SUMMARY OF THE INVENTION

The present invention comprises a toilet paper dispenser which stores several rolls in a vertical column. The rolls are individually dispensed via a swinging carriage located near the column's top. A spring-loaded follower urges the stack of rolls upward, so that as each roll is dispensed, the one immediately below takes its place. The dispensing mechanism is designed so that one and only one roll is dispensed for each cycle of the swinging carriage.

Figure 1:
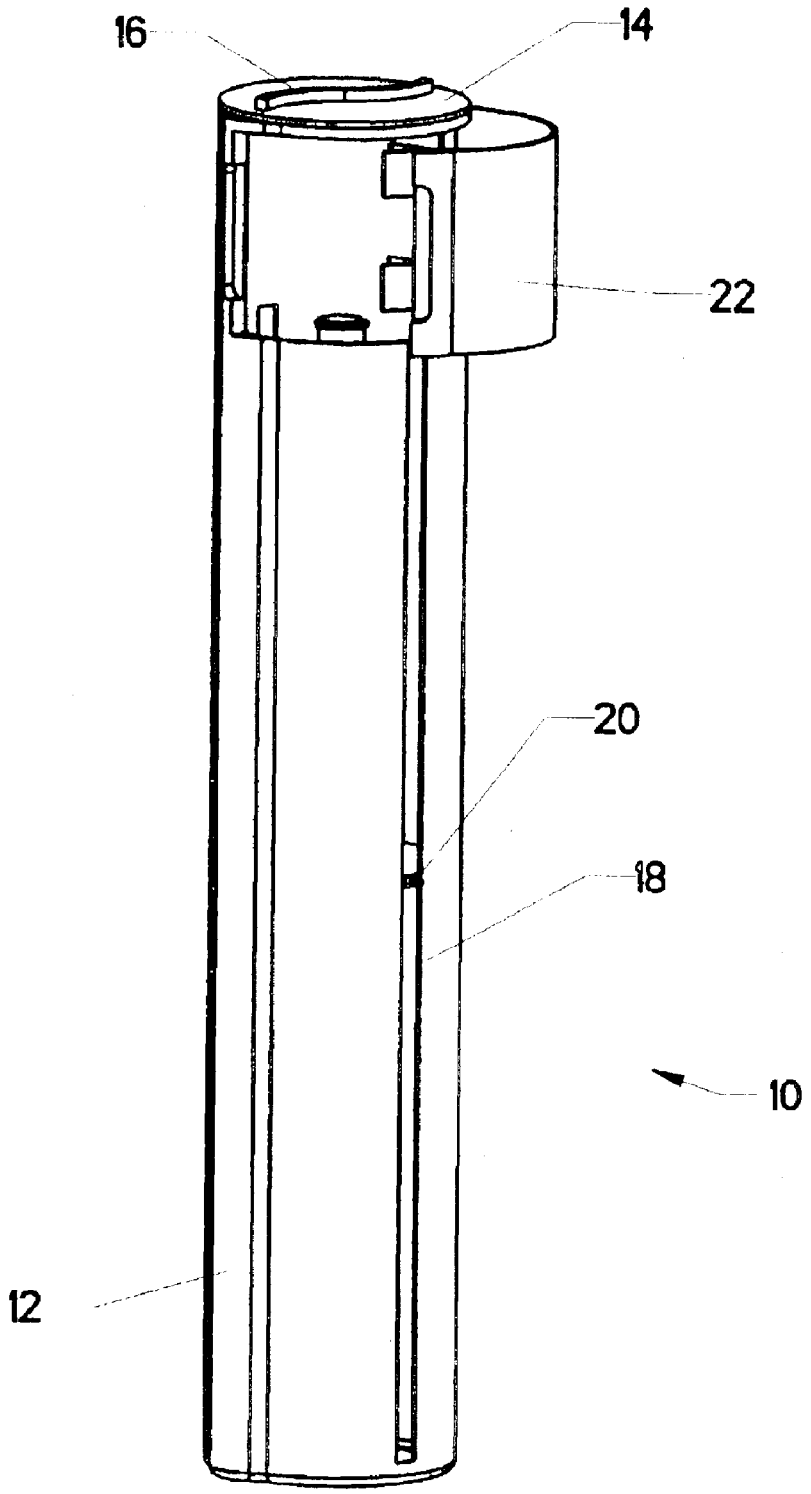
FIG. 1 is a perspective view, showing the roll dispenser.

| REFERENCE NUMERALS IN THE DRAWINGS | |
|---|---|
| 10 | roll dispenser |
| 12 | column |
| 14 | lid |
| 16 | grip |
| 18 | slot |
| 20 | tab |
| 22 | carriage |
| 24 | spindle |
| 26 | follower |
| 28 | spring |
| 30 | loading port |
| 32 | roll |
| 34 | stop collar |
| 36 | pivot pin |
| 38 | center tube |
| 40 | pin receiver |
| 42 | ejector finger |
| 44 | finger relief |
| 46 | ejector finger relief |
| 48 | ejection port |

DETAILED DESCRIPTION OF THE INVENTION

FIG. 1 shows roll dispenser 10 as it would ordinarily rest on the floor (in a vertical orientation). The device is placed on the floor, typically in a corner or next to a wall of a bathroom. A larger base can be added for extra stability if desired.

The primary structural element of roll dispenser 10 is column 12, which is essentially a hollow cylinder. Its lower end is closed, whereas its upper end is open. Lid 14 selectively closes this open end. It can be attached to column 12 by any convenient means, such as threads, snaps, etc. The particular embodiment shown is threaded into place. Grip 16 allows the user to easily grasp and rotate lid 14.

The upper portion of column 12 opens into ejection port 48. This port is selectively opened and closed by carriage 22, which is pivotally attached to column 12. Carriage 22 is shown partially open in view.

Column 12 also has two vertical slots 18. Only one is visible in FIG. 1. Its counterpart is found in the portion of the column facing away from the viewer. Two tabs 20 ride up and down within the two slots 18.

Figure 2:
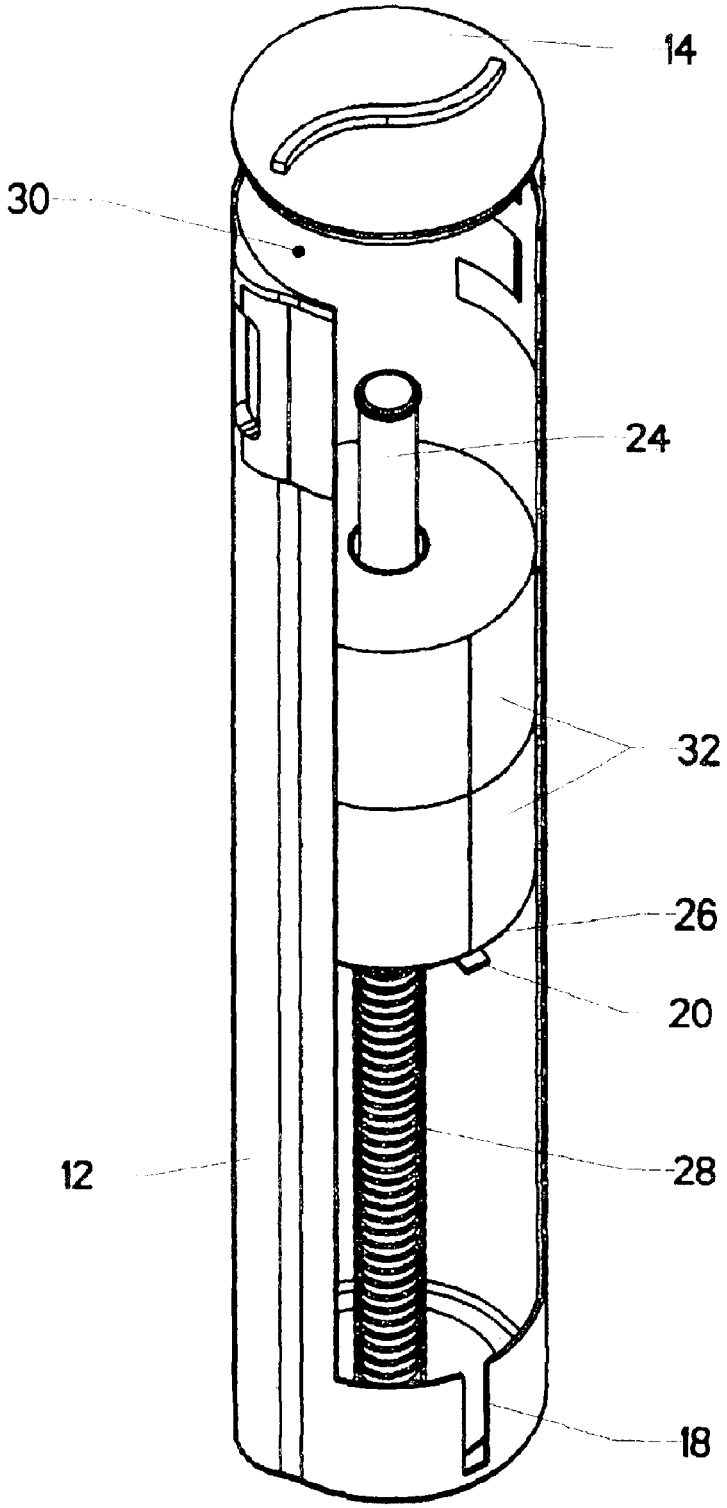
FIG. 2 is a perspective view with a cutaway, showing the internal details of the roll dispenser.

FIG. 2 shows the same assembly with a cutaway (the carriage has been rotated into the closed position. Lid 14 has been removed to expose the open upper end of column 12—designated as loading port 30. Spindle 24 is located in the center of column 12's hollow interior. Follower 26 is urged upward on spindle 24 by the action of spring 28. When rolls 32 are placed on spindle 24, follower 26 urges them upward. The reader will observe that tab 20 is actually connected to follower 26 so that it moves with follower 26.

Figure 3:
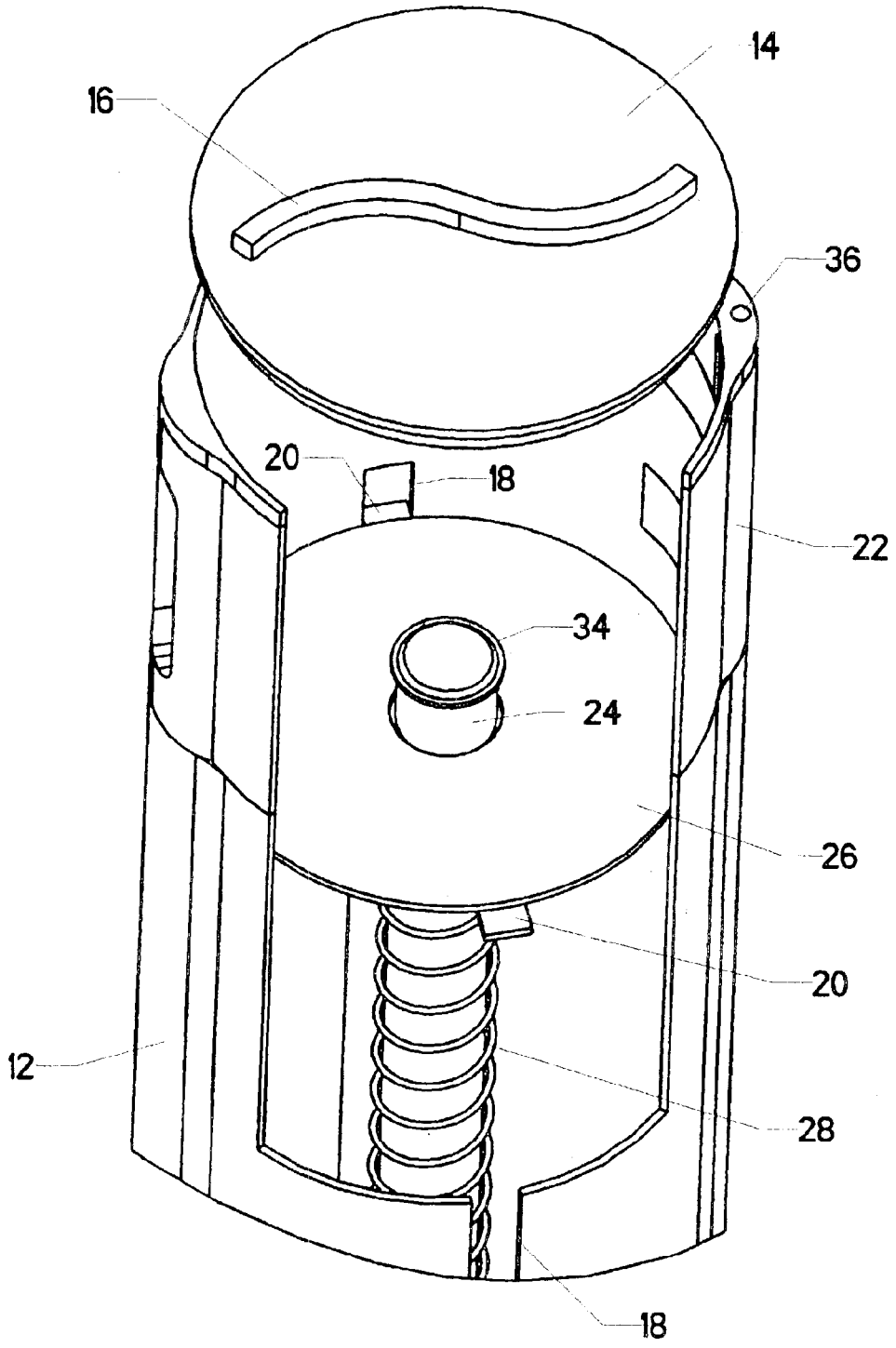
FIG. 3 is a perspective detail view with a cutaway, showing the internal details of the roll dispenser.

FIG. 3 shows a detail view of the same assembly with the rolls removed. Both slots 18 are visible, as are both tabs 20. The top of spindle 24 has stop collar 34, which arrests the upward travel of follower 26 once it reaches this point. The reader will observe that the aforementioned pivotal connection between carriage 22 and column 12 is made by pivot pin 36.

Figure 4:
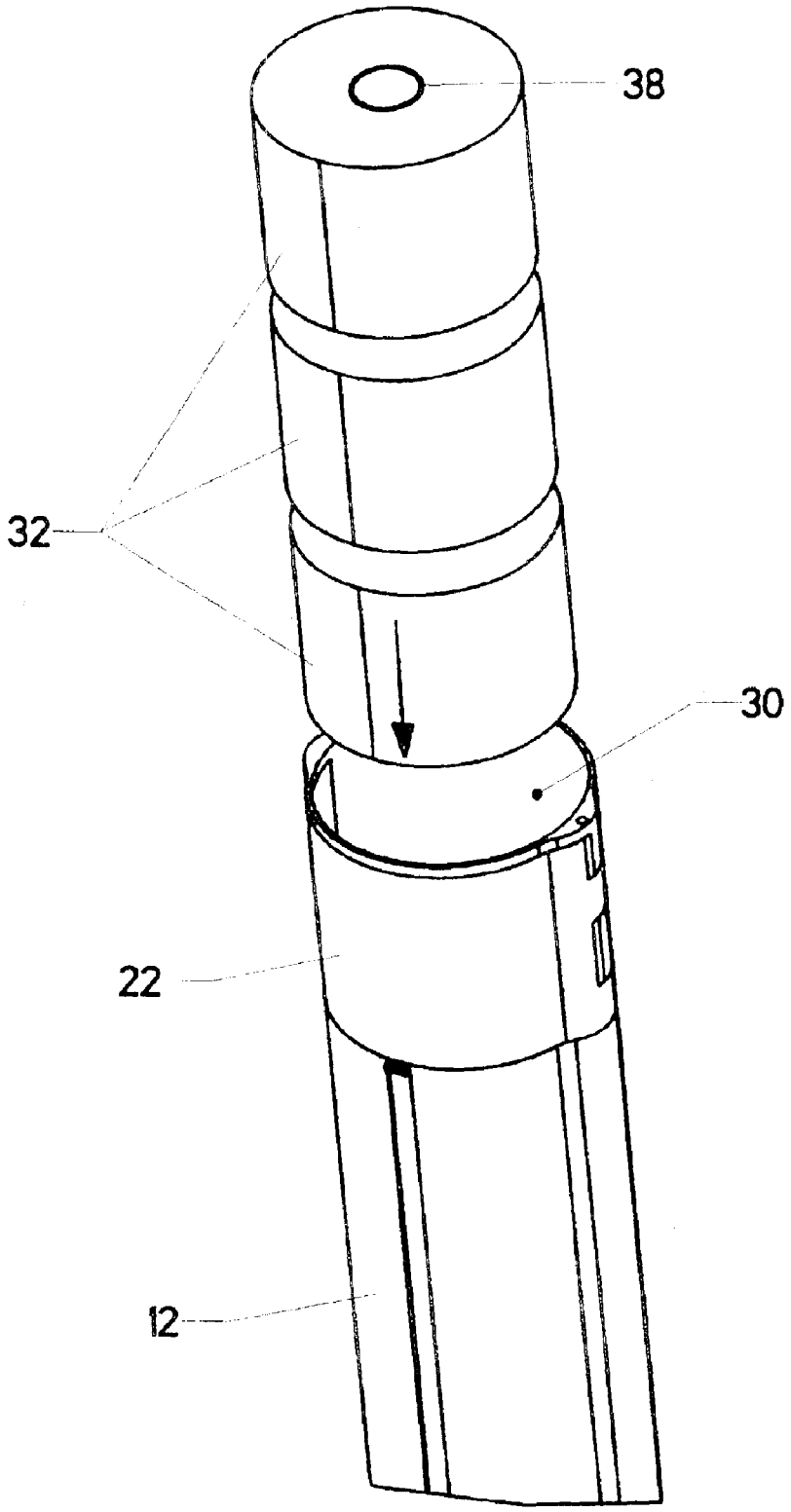
FIG. 4 is a perspective view, showing the loading of the roll dispenser.

FIG. 4 shows the loading of the device. A plurality of rolls 32 is inserted through the open loading port 30 (the lid is removed). Center tube 38 of each roll 32 is slipped over spindle 24. If the uppermost role is denoted as the "first" roll, and the one immediately below the "second" roll, then the operation of the device can be generally described as follows: Once the lid is replaced, spring 28 will urge the rolls upward, so that the first roll lies at the top of column 12, under lid 14. It therefore lies inside carriage 22. When carriage 22 is rotated outward, this first roll is dispensed. The second roll is then urged upward to take the place of the first roll, whereupon the cycle repeats.

Figure 5:
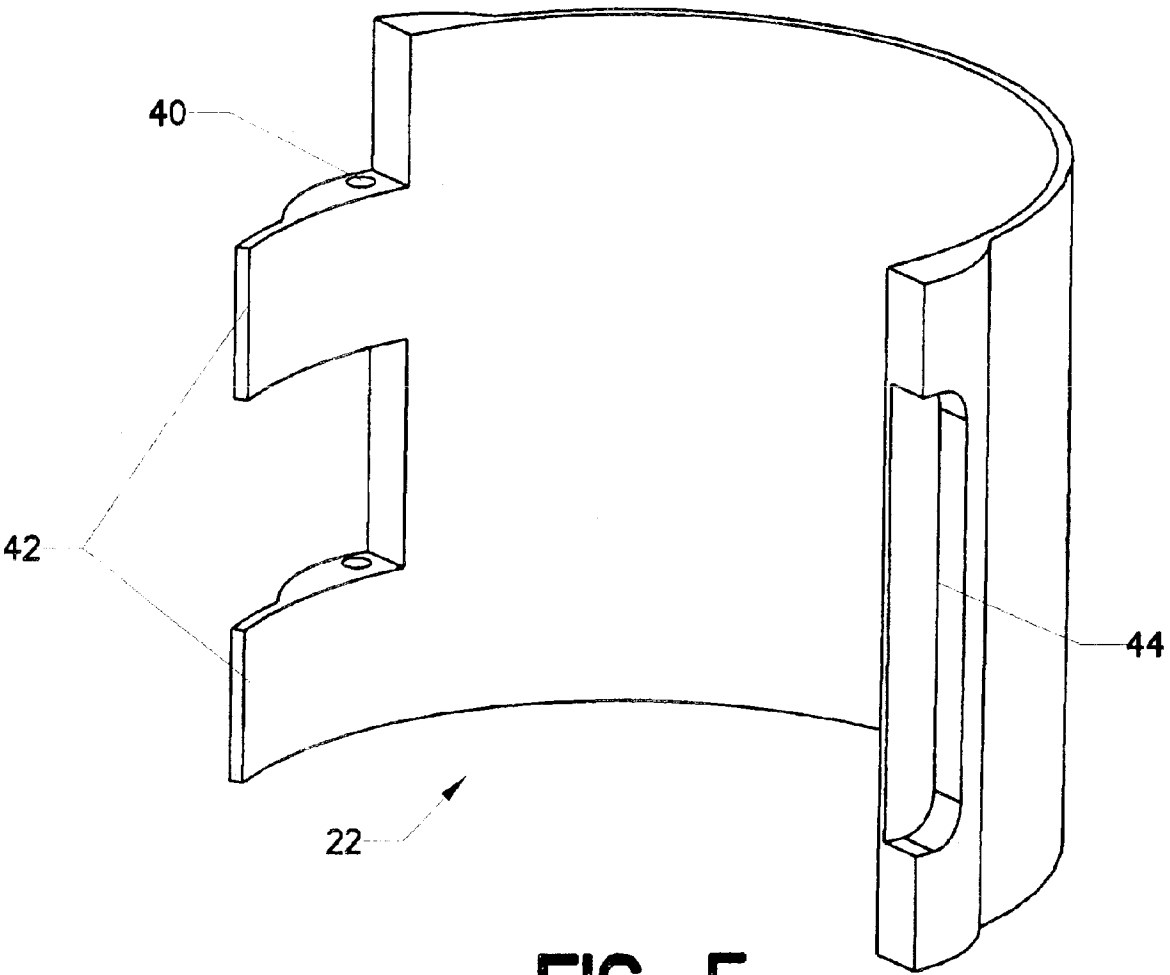
FIG. 5 is a perspective view, showing the carriage.

Additional features are desirable to facilitate a smooth dispensing cycle. These will now be described in detail. FIG. 5 shows carriage 22 in more detail. Pin receiver 40 is provided to receive pivot pin 36. Two ejector fingers 42 are provided adjacent to pin receiver 40. Finger relief 44 is provided on the opposite side of carriage 22. This feature allows the user to more easily grip and open carriage 22.

Figure 6:
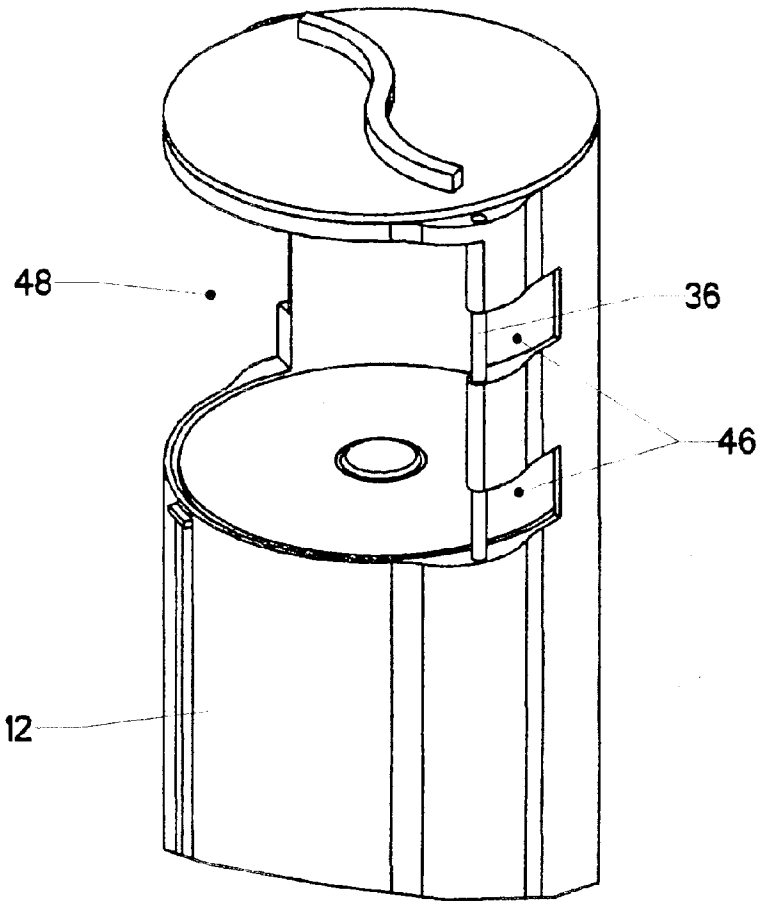
FIG. 6 is a perspective view, showing the upper portion of the dispenser with the carriage removed.

FIG. 6 shows the corresponding features defining ejection port 48 (Carriage 22 is shown removed in the view). Pivot pin 36 defines the pivoting joint. Two ejector finger reliefs 46 are provided to receive the two ejector fingers 42 on carriage 22.

Figure 7:
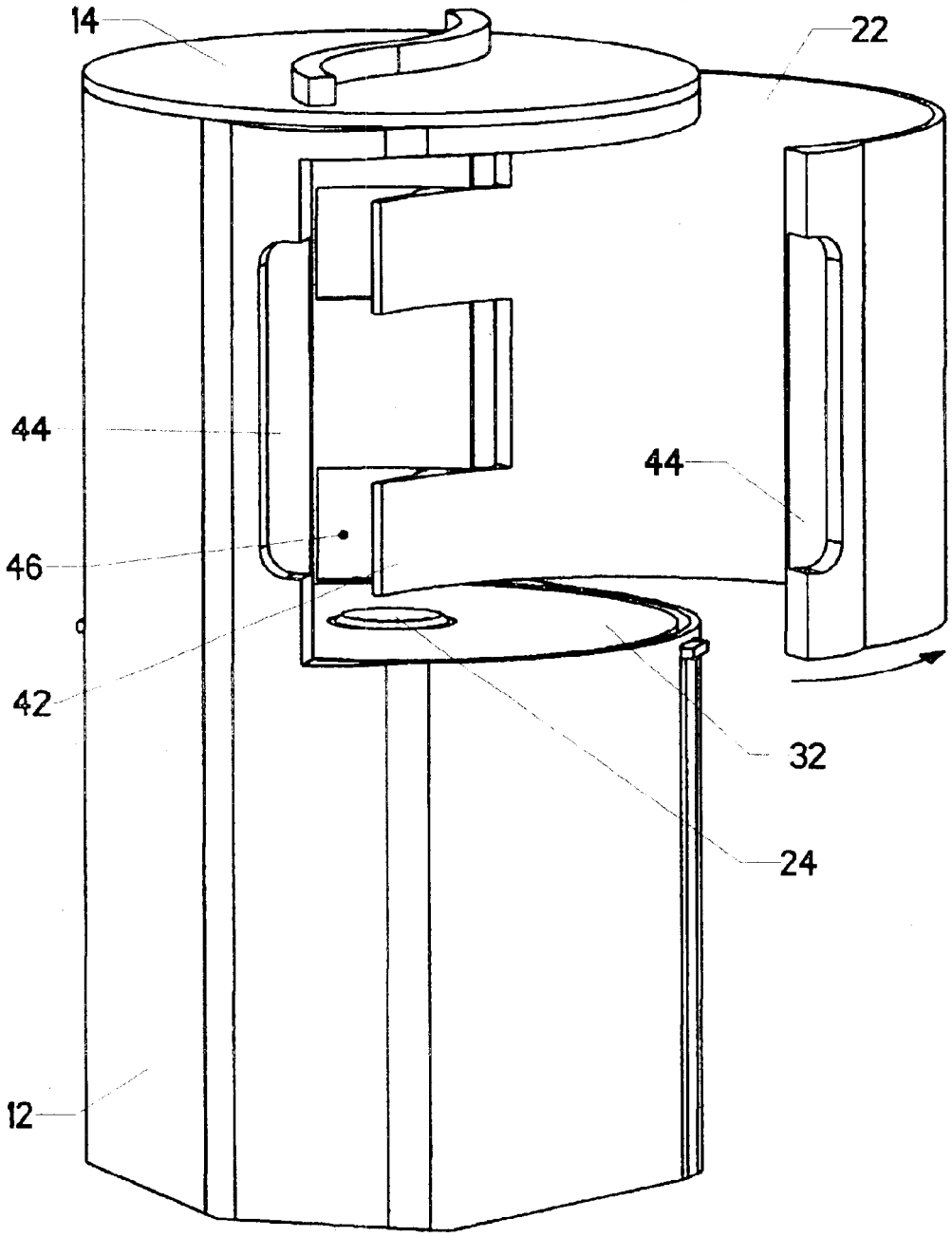
FIG. 7 is a perspective view, showing the operation of the carriage.

FIG. 7 shows the upper part of the dispenser with carriage 22 rotated partially open. The reader will observe that the lower ejector finger 42 rotates over the top of the "second" roll 32 as carriage 22 swings open. This feature prevents the second roll from rising upward under the influence of spring 28. The reader will also observe that a finger relief 44 is provided in column 12 to correspond to the finger relief 44 found in carriage 22. These two reliefs allow the user to easily grasp carriage 22 when it is in the closed position, so that it may be rotated toward the open position.

Figure 8:
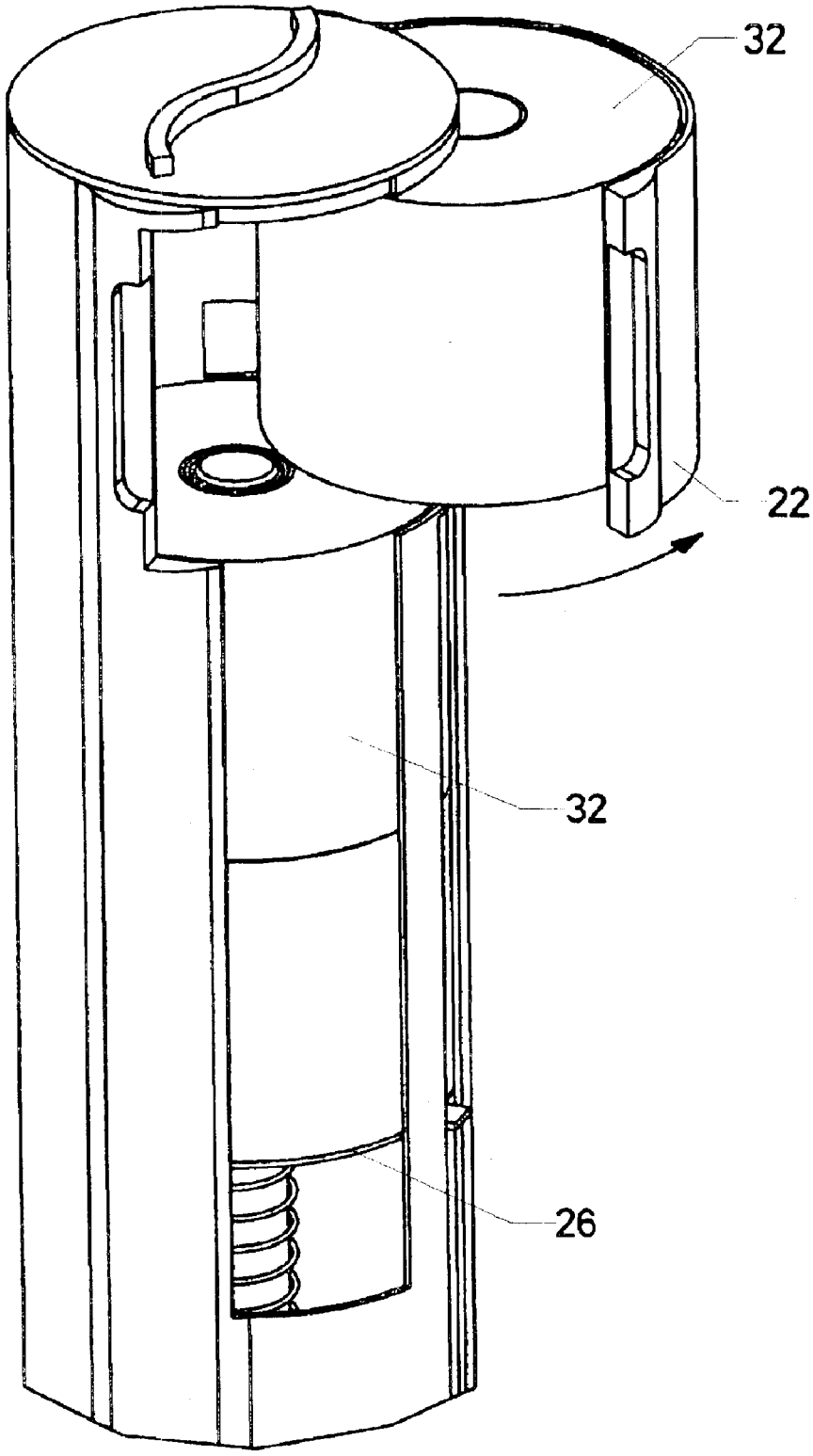
FIG. 8 is a perspective view, showing the operation of the carriage.

FIG. 8 shows the actual dispensing cycle (including a cutaway to aid visualization). When the device is loaded, the upper or "first" roll always lies within carriage 22. When carriage 22 is rotated open, the two ejector fingers 42 push against the back side of the first roll and urge it outward as shown. The user then grasps the first roll and pulls it free for use.

Figure 9:
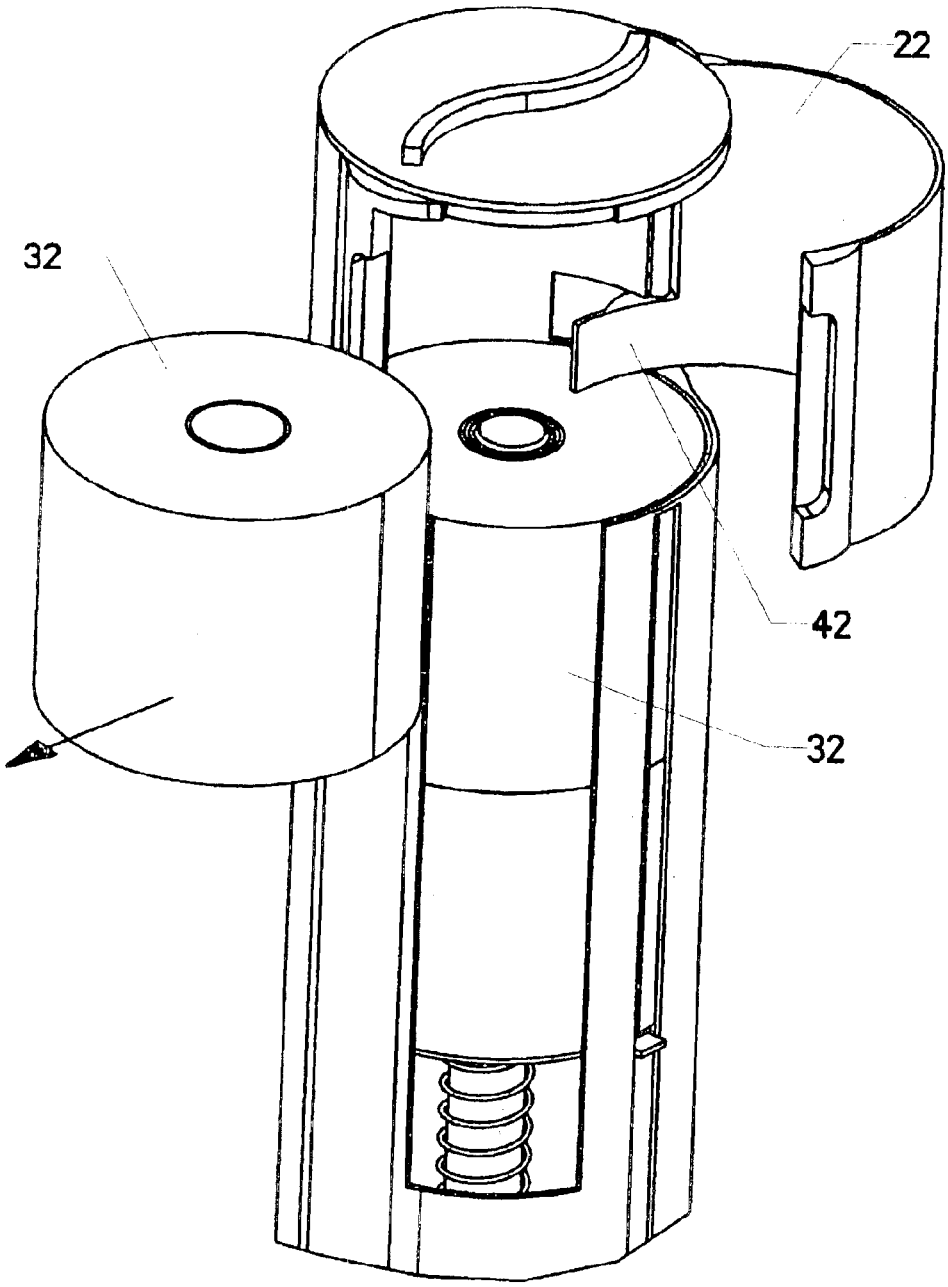
FIG. 9 is a perspective view, showing the dispensing of a roll.

FIG. 9 shows this configuration once the first roll has been pulled free. The reader will observe the position of the lower ejector finger 42, which now rests over the "second" roll 32 and holds it in place. This fact allows the easy removal of the first roll, since the second roll is not being urged upward against its lower surface, thereby jamming it.

Figure 10:
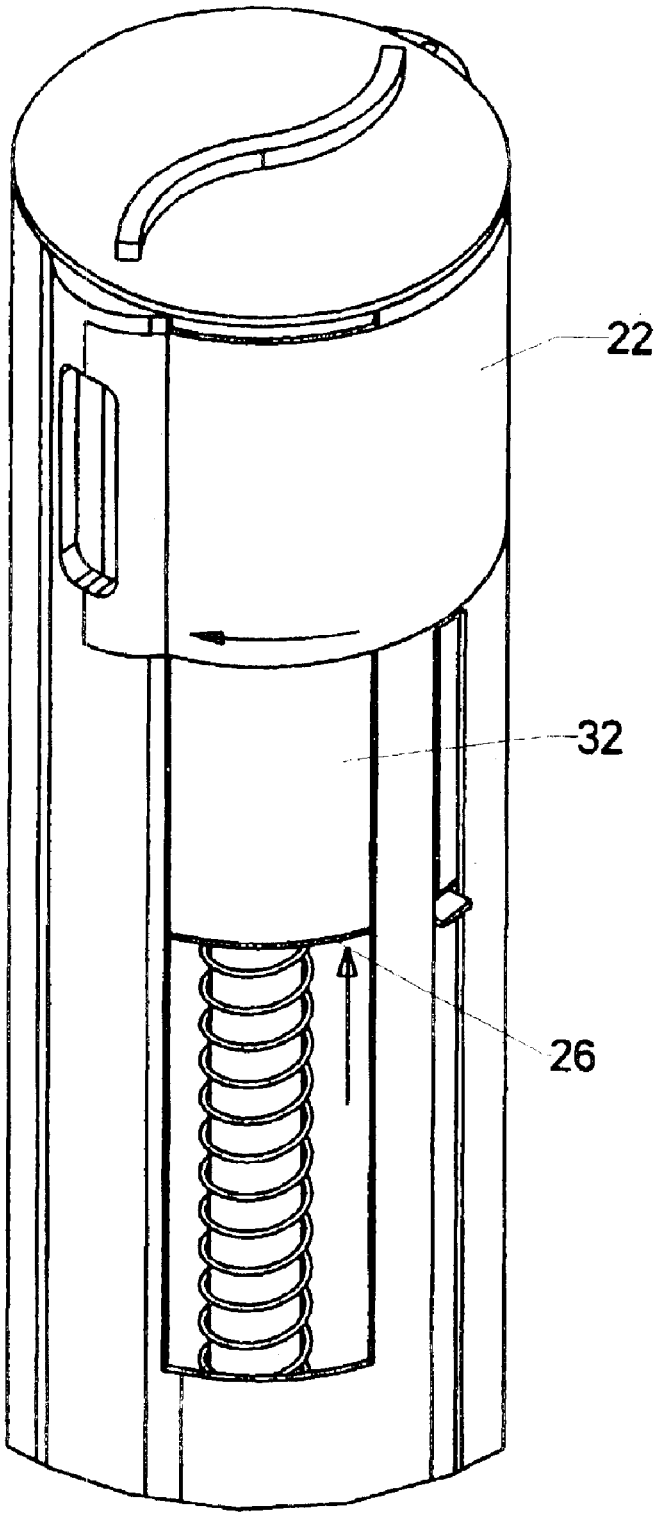
FIG. 10 is a perspective view, showing the completion of a dispensing cycle.

FIG. 10 shows the cycle once carriage 22 is closed. The closing of the carriage places the lower ejector finger 42 back within ejector finger relief 46, removing the impediment to the upward travel of the second roll. Follower 26 then moves upward and the "second" roll becomes the "first "roll." The cycle may then be repeated.

Those skilled in the art will realize that the embodiment shown can store up to six rolls. Those skilled in the art will also realize that taller and shorter versions can be made to store different quantities. Tab 20—moving in slot 18—provides a convenient visual indication regarding the number of rolls remaining in the dispenser. As it moves upward, the user knows the number of rolls is diminishing. Text or graphical symbols can be placed on the outside of column 12 near slot 18 to assist the indication function. Column 18 could also be molded from transparent material so that the user could actually see the rolls inside.

The preceding description contains significant detail regarding the novel aspects of the present invention. It should not be construed, however, as limiting the scope of the invention but rather as providing illustrations of the preferred embodiments of the invention. As an example—the dispenser need not be mounted vertically. It could also be mounted horizontally along the wall of a bathroom stall. Follower 26 would then urge the rolls from one side to the other rather than upwards. The device would otherwise function in the same fashion. Thus, the scope of the invention should be fixed by the following claims, rather than by the examples given.

We claim:

1. A dispenser for dispensing a plurality of rolls of toilet paper including a first roll and a second roll, comprising:

a. a hollow column, having a first end, and a second end, wherein said second end is open so that said plurality of rolls of toilet paper can be loaded into said hollow column through said second end;

b. a removable lid, for closing said second end of said hollow column once said plurality of rolls of toilet paper is loaded;

c. wherein said hollow column opens into an ejection port proximate said second end;

d. biasing means for urging said plurality of rolls of toilet paper toward said second end of said column, so that said first roll lies proximate said ejection port;

e. a carriage, pivotally attached to said hollow column proximate said ejection port, wherein said carriage can be rotated from a closed position wherein said carriage closes said ejection port, to an open position, wherein said carriage ejects said first roll from said hollow column through said ejection port.

2. A dispenser as recited in claim 1, wherein said carriage comprises:

a. a pivot joint, pivotally connecting said carriage to said hollow column;

b. an arcuate wall, located on a first side of said pivot joint and configured to close said ejection port when said carriage is in said closed position; and c. an ejector finger, located on a second side of said pivot joint, so that when said carriage is rotated toward said open position, said ejection finger bears against said first roll and forces said first roll into said ejection port.

3. A dispenser as recited in claim 2, wherein:

a. said carriage has a first boundary proximate said second end of said column and a second boundary distal to said second end of said column; and b. said ejector finger is located proximate said second boundary of said carriage, so that when said carriage is rotated toward said open position, said ejector finger lies over said second roll and prevents said second roll moving toward said second end of said column.

4. A dispenser as recited in claim 1, further comprising a spindle within said column.

5. A dispenser as recited in claim 2, further comprising a spindle within said column.

6. A dispenser as recited in claim 3, further comprising a spindle within said column.

7. A dispenser as recited in claim 4, wherein said biasing means for urging said plurality of rolls of toilet paper toward said second end of said column comprises a follower slidably mounted on said spindle and a spring urging said follower toward said second end of said column.

8. A dispenser as recited in claim 5, wherein said biasing means for urging said plurality of rolls of toilet paper toward said second end of said column comprises a follower slidably mounted on said spindle and a spring urging said follower toward said second end of said column.

9. A dispenser as recited in claim 6, wherein said biasing means for urging said plurality of rolls of toilet paper toward said second end of said column comprises a follower slidably mounted on said spindle and a spring urging said follower toward said second end of said column.

10. A dispenser as recited in claim 7, wherein:

a. said column opens into a slot; and b. said follower includes a tab, slidably movable within said slot in order to indicate how many rolls are present in said dispenser.

11. A dispenser as recited in claim 8, wherein:

a. said column opens into a slot; and b. said follower includes a tab, slidably movable within said slot in order to indicate how many rolls are present in said dispenser.

12. A dispenser as recited in claim 9, wherein:

a. said column opens into a slot; and b. said follower includes a tab, slidably movable within said slot in order to indicate how many rolls are present in said dispenser.

* * * * *